US009620837B2

(12) United States Patent
Ezzeddine et al.

(10) Patent No.: US 9,620,837 B2
(45) Date of Patent: Apr. 11, 2017

(54) BANDPASS MICROWAVE FILTER TUNABLE BY RELATIVE ROTATION OF AN INSERT SECTION AND OF A DIELECTRIC ELEMENT

(71) Applicants: THALES, Neuilly-sur-Seine (FR); CENTRE NATIONAL DE LA RECHERCHE SCIENTIFIQUE, Paris (FR); CENTRE NATIONAL D'ETUDES SPATIALES, Paris (FR)

(72) Inventors: Hussein Ezzeddine, Tours (FR); Aurelien Perigaud, Panazol (FR); Olivier Tantot, Limoges (FR); Nicolas Delhote, Limoges (FR); Stephane Bila, Verneuil/sur/Vienne (FR); Serge Verdeyme, Aixe/sur/Vienne (FR); Damien Pacaud, Beaumont/sur/Leze (FR); Laetitia Estagerie, Tournefeuille (FR)

(73) Assignees: THALES, Courbevoie (FR); CENTRE NATIONAL DE LA RECHERCHE SCIENTIFIQUE, Paris (FR); CENTRE NATIONAL D'ETUDES SPATIALES, Paris (FR)

( * ) Notice: Subject to any disclaimer, the term of this patent is extended or adjusted under 35 U.S.C. 154(b) by 77 days.

(21) Appl. No.: 14/574,255

(22) Filed: Dec. 17, 2014

(65) Prior Publication Data

US 2015/0180106 A1 Jun. 25, 2015

(30) Foreign Application Priority Data

Dec. 20, 2013 (FR) ..... 13 03030

(51) Int. Cl.
*H01P 1/20* (2006.01)
*H01P 1/208* (2006.01)
(Continued)

(52) U.S. Cl.
CPC ..... *H01P 1/2086* (2013.01); *H01P 1/2084* (2013.01); *H01P 7/105* (2013.01);
(Continued)

(58) Field of Classification Search
CPC .... H01P 1/2082; H01P 1/2084; H01P 1/2086; H01P 7/10; H01P 7/105
(Continued)

(56) References Cited

U.S. PATENT DOCUMENTS 5,352,997 A * 10/1994 Sarkka ..... H01P 7/10 333/219.1
5,495,216 A * 2/1996 Jachowski ..... H01P 1/2086 333/208
(Continued)

*Primary Examiner* — Benny Lee
(74) *Attorney, Agent, or Firm* — Baker & Hostetler LLP

(57) ABSTRACT

A bandpass filter for microwave-frequency wave which is frequency tunable, comprises at least one resonator. Each resonator comprises a cavity having a conducting wall substantially cylindrical in relation to an axis Z, and at least one dielectric element disposed inside the cavity. The resonator resonates on two perpendicular polarizations having respectively distributions of the electromagnetic field in the cavity that are deduced from one another by a rotation of 90° and according to one and the same frequency. The wall of the cavity comprises an insert section facing the element having a different shape from a section not situated facing the element. The insert section and the element are able to perform a rotation with respect to one another in relation to the axis Z so as to define at least a first and a second relative position differing by an angle substantially equal to 45° to within 20°.

17 Claims, 9 Drawing Sheets

(51) Int. Cl.

| | |
|---|---|
| ***H01P 7/10*** | (2006.01) |
| *H01P 1/207* | (2006.01) |
| *H01P 5/02* | (2006.01) |
| *H01P 7/06* | (2006.01) |

(52) U.S. Cl.
CPC ..... *H01P 1/207* (2013.01); *H01P 5/02* (2013.01); *H01P 7/06* (2013.01); *H01P 7/10* (2013.01)

(58) Field of Classification Search
USPC ..... 333/202, 235
See application file for complete search history.

(56) References Cited

U.S. PATENT DOCUMENTS

| | | | | |
|---|---|---|---|---|
| 5,796,318 | A | 8/1998 | Ando et al. | |
| 2001/0007439 | A1* | 7/2001 | Latouche et al. ..... | H01P 1/2086 333/202 |
| 2007/0159275 | A1 | 7/2007 | Craig et al. | |
| 2014/0320237 | A1* | 10/2014 | Pacaud et al. ..... | H01P 1/2086 333/202 |

* cited by examiner

BANDPASS MICROWAVE FILTER TUNABLE BY RELATIVE ROTATION OF AN INSERT SECTION AND OF A DIELECTRIC ELEMENT

CROSS-REFERENCE TO RELATED APPLICATION

This application claims priority to foreign French patent application No. FR 1303030, filed on Dec. 20, 2013, the disclosure of which is incorporated by reference in its entirety.

FIELD OF THE INVENTION

The present invention relates to the field of frequency-type filters in the microwave region, typically for frequencies lying between 1 GHz to 30 GHz. More particularly the present invention relates to frequency-tunable bandpass filters.

BACKGROUND

The processing of a microwave-frequency wave, for example received by a satellite, requires the development of specific components, allowing propagation, amplification, and filtering of this wave.

For example, a microwave-frequency wave received by a satellite must be amplified before being returned to the ground. This amplification is possible only by separating the set of frequencies received into channels, each channel corresponding to a given frequency band. Amplification is then carried out channel by channel. The separation of the channels requires the development of bandpass filters.

The development of satellites and the increased complexity of the signal processing to be performed, for example, reconfiguration of the channels in flight, has led to the necessity to implement frequency-tunable bandpass filters, that is to say filters for which it is possible to adjust the central filtering frequency customarily referred to as the filter tuning frequency.

One of the known technologies of bandpass filters that are tunable in the microwave region is the use of passive and/or semi-conducting components, such as PIN diodes, continuously variable capacitors or capacitive switches. Another technology is the use of MEMS (for micro electromechanical systems) of ohmic or capacitive type.

These technologies are complex, inefficient in terms of electrical energy and not very reliable. These solutions are also limited at the level of the signal power processed. Moreover, a consequence of frequency tunability is an appreciable degradation in the performance of the filter, such as its quality factor Q. Finally, the RF losses (operating frequency band of the filter, "Return Loss", insertion losses, etc.) are degraded by the change of frequency.

Furthermore, the technology of filters based on dielectric elements is known in the art. The use of dielectric elements makes it possible to produce non-tunable bandpass filters.

These filters typically comprise a closed cavity that is at least partially closed, comprising a conducting wall (typically metallic, for example made of aluminium or INVAR™ or other types of similar alloys) in which is disposed a dielectric element, typically of round or square shape (the dielectric material is typically zirconia, alumina or barium magnesium tantalate (BMT)).

An input excitation means introduces the wave into the cavity (for example, a coaxial cable terminated by an electrical probe or a waveguide coupled by an iris) and an output excitation means of like nature makes it possible for the cavity to output the wave.

A bandpass filter allows the propagation of a wave over a certain frequency span and attenuates this wave for the other frequencies. A passband and a central frequency of the filter are thus defined. For frequencies around its central frequency, a bandpass filter has high transmission and low reflection.

The passband of the filter is characterized in various ways according to the nature of the filter.

The parameter S is a parameter which expresses the performance of the filter in terms of reflection and transmission. For example, S11, or S22, corresponds to a measure of reflection and S12, or S21, to a measure of transmission.

A filter carries out a filtering function. This filtering function can generally be approximated via mathematical models (Chebychev functions, Bessel functions, etc.). These filtering functions are generally based on ratios of polynomials.

For a filter carrying out a filtering function of Chebychev or generalized Chebychev type, the passband of the filter is determined at equi-ripple of S11 (or S22), for example, at 15 dB or 20 dB reduction in reflection with respect to its out-of-band level. For a filter carrying out a function of Bessel type, the band is taken at −3 dB (when a curve for S21 intersects a curve for S11 if the filter has negligible losses).

A filter typically comprises at least one resonator comprising the metallic cavity and the dielectric element. A mode of resonance of the filter corresponds to a particular distribution of the electromagnetic field which is excited at a particular frequency.

In order to increase filter selectivity, that is to say the capacity of the filter to attenuate the signal outside of the passband of the filter, these filters can be composed of a plurality of mutually coupled resonators.

The central frequency and the passband of the filter depend both on the geometry of the cavities and dielectric elements, as well as the mutual coupling of the resonators as well as couplings with the filter input and output excitation means. Coupling means are, for example, openings or slots referred to as irises, electrical or magnetic probes or microwave lines.

The filter allows through a signal whose frequency lies in the passband of the filter, but the signal is nonetheless attenuated by the filter losses.

The tuning of the filter making it possible to obtain a transmission maximum for a given frequency band is very challenging and depends on the whole set of parameters of the filter. It is, moreover, further dependent on the temperature.

In order to perform an adjustment of the filter so as to obtain a precise central frequency of the filter, the resonant frequencies of the resonators of the filter can be very slightly modified with the aid of metallic screws, but this method performed in an empirical manner is very time consuming and allows limited frequency tunability, typically of the order of a few percentages (%). In this case, the objective is not tunability but the obtaining of a precise value of the central frequency, and it is desired to obtain reduced sensitivity of the frequency of each resonator in relation to the depth of the screw.

The circular or square symmetry of the resonators simplifies the design of the filter.

Depending on its geometry, generally a resonator has one or more resonant modes each characterized by a particular (distinctive) distribution of the electromagnetic field giving rise to a resonance of the microwave-frequency wave in the structure at a particular frequency. For example, TE (for Transverse Electric or "H") or TM (for Transverse Magnetic or E) modes of resonance having a certain numbers of energy maxima labelled by indices, may be excited in the resonator at various frequencies. FIG. 1 illustrates, by way of example, the resonant frequencies (f) of the various modes for an empty circular cavity as a function of the dimensions of the cavity (diameter D and height H). FIG. 1 illustrates the square of the resonance frequency f multiplied by the diameter D divided by $10^4$, $(f.D/10^4)^2$ as a function of the square of the diameter D of the cavity divided by the height H of the cavity, $(D/H)^2$ for different modes TE and TM defined by the numbers of maxima labelled by three subscripts, for example, $TE_{111}$, $TE_{011}$, $TE_{212}$, $TM_{110}$, and $TM_{011}$, etc.

To optimize the compactness of the filters, resonator filters operating on several modes (typically 2 or 3) are known in the art. In particular, filters operating according to a dual mode ("dual mode filter") are known. These modes have two perpendicular polarizations X and Y having a distinctive and specific distribution of the electromagnetic field in the cavity: the distributions of the electromagnetic fields corresponding to the two polarizations are orthogonal and the distributions corresponding to the two polarizations Px and Py are deduced or obtained from one another by a rotation of 90° about an axis of symmetry of the resonator.

If the symmetry of the resonator is perfect, the two orthogonal polarizations possess the same resonant frequency and are not coupled. The coupling between polarizations is obtained by breaking the symmetry, for example, by introducing a discontinuity (perturbation) at 45° of the polarization axes X and Y, typically with the aid of metallic screws.

Moreover, the resonant frequencies can be tuned (optionally to different frequencies) by introducing discontinuities (perturbations) into the polarization axes (X and Y).

Thus, the two polarizations X and Y of a dual mode can resonate according to one and the same frequency (symmetry in relation to the polarization axes) or according to two slightly different frequencies (dissymmetry in relation to the polarization axes).

The dual modes thus make it possible to achieve two electrical resonances in one resonant element. Several modes possessing these particular field distributions can be used. For example, the dual modes TE11n (H11n) are extensively used in cavity filters since they culminate in a good compromise between a high quality factor (the compromise being more with an increasing value of the index n, n being an integer), reduced bulkiness (reduced by half when employing dual modes) and significant frequency isolation with respect to the other resonant modes (that it is not desired to couple in order to ensure the proper operation of the filter).

SUMMARY OF THE INVENTION

The aim of the present invention is to produce filters of cavity type with dielectric elements, which are compact, tunable in terms of central frequency, and do not have the aforementioned drawbacks (quality factor and RF losses degraded through tunability, poor power withstanding capability, etc.).

For this purpose the subject of the invention is a bandpass filter for microwave-frequency wave, the bandpass filter being frequency tunable, comprising at least one resonator, each resonator comprising a cavity having a conducting wall substantially cylindrical in relation to an axis Z, and at least one dielectric element disposed inside the cavity, the resonator resonating at two perpendicular polarizations having respectively distributions of the electromagnetic field in the cavity, the distributions corresponding to the two polarizations are deduced or obtained from one another by a rotation of 90°, the wall of the cavity comprising an insert section facing the dielectric element having a different shape from a section not situated facing the dielectric element, the insert section and the dielectric element being able to perform a rotation with respect to one another in relation to the axis Z so as to define at least a first and a second relative position differing by an angle substantially equal to 45° to within 20°.

According to one embodiment, at least one shape from among the shape of the insert section and the shape of the dielectric element comprises at least two orthogonal symmetry planes intersecting one another along the axis Z.

Advantageously, the shape of the insert section and the shape of the dielectric element each comprise at least two orthogonal symmetry planes S1, S3, Si1, Si3 intersecting one another along the axis Z.

Advantageously, the first position is such that the symmetry planes of the insert section coincide with the symmetry planes of the dielectric element to within 10°.

According to one embodiment at least one shape from among the shape of the insert section and the shape of the dielectric element has four symmetry planes S1, S2, S3, S4, Si1, Si2, Si3, Si4, two adjacent symmetry planes being separated by an angle of 45°, and intersecting one another along the axis Z.

Advantageously, at least one shape from among the shape of the insert section and the shape of the dielectric element has concavities and/or convexities having extrema which are situated in the vicinity of axes of symmetry.

Preferably, the substantially cylindrical shape has a base chosen from among a circle and a square.

Preferably, a mode of resonance of the resonator is of the type H113 having three maxima of the electric field in the cavity along the axis Z.

As a variant, the resonator furthermore comprises means of rotation able to carry out the rotation.

According to one embodiment, the insert section is movable with respect to the conducting wall.

Preferably, the movable insert section comprises a movable adjusting ring.

According to one embodiment the dielectric element is movable with respect to the conducting wall.

Advantageously, the means of rotation comprise a rod rigidly attached to the dielectric element and comprising a dielectric material.

According to one embodiment, the filter comprises a plurality of resonators and coupling means adapted for coupling together two adjacent resonators.

Preferably, the filter furthermore comprises linking means adapted for equalizing the respective rotations of the means of rotation of the resonators.

Advantageously, the linking means comprise the rod rigidly attached to a plurality of dielectric elements disposed along the rod.

According to another aspect, the invention relates to a microwave circuit comprising at least one filter according to the invention.

BRIEF DESCRIPTION OF THE DRAWINGS

Other characteristics, aims and advantages of the present invention will become apparent on reading the detailed description which will follow and with regard to the appended drawings provided by way of nonlimiting examples, where like elements/features are denoted by the same reference numbers, and in which:

FIG. 4*a* describes the resonator of the filter according to a first position P1 and FIG. 4*b* describes the resonator of the filter according to a second relative position P2.

FIG. 5*a* describes the resonator of the filter according to a first position P1 and FIG. 5*b* describes the resonator of the filter according to a second relative position P2.

DETAILED DESCRIPTION OF THE INVENTION

The invention is directed to producing a bandpass filter that is tunable in terms of central frequency, the filter being a "dual mode" type filter, the dual modes being obtained on the basis of a rotation of various elements making up the filter. The filter comprises at least one resonator R, each resonator comprising a cavity 30 having a, typically metallic, a conducting wall substantially cylindrical in relation to an axis Z, and at least one dielectric element disposed inside the cavity.

Figure 1:
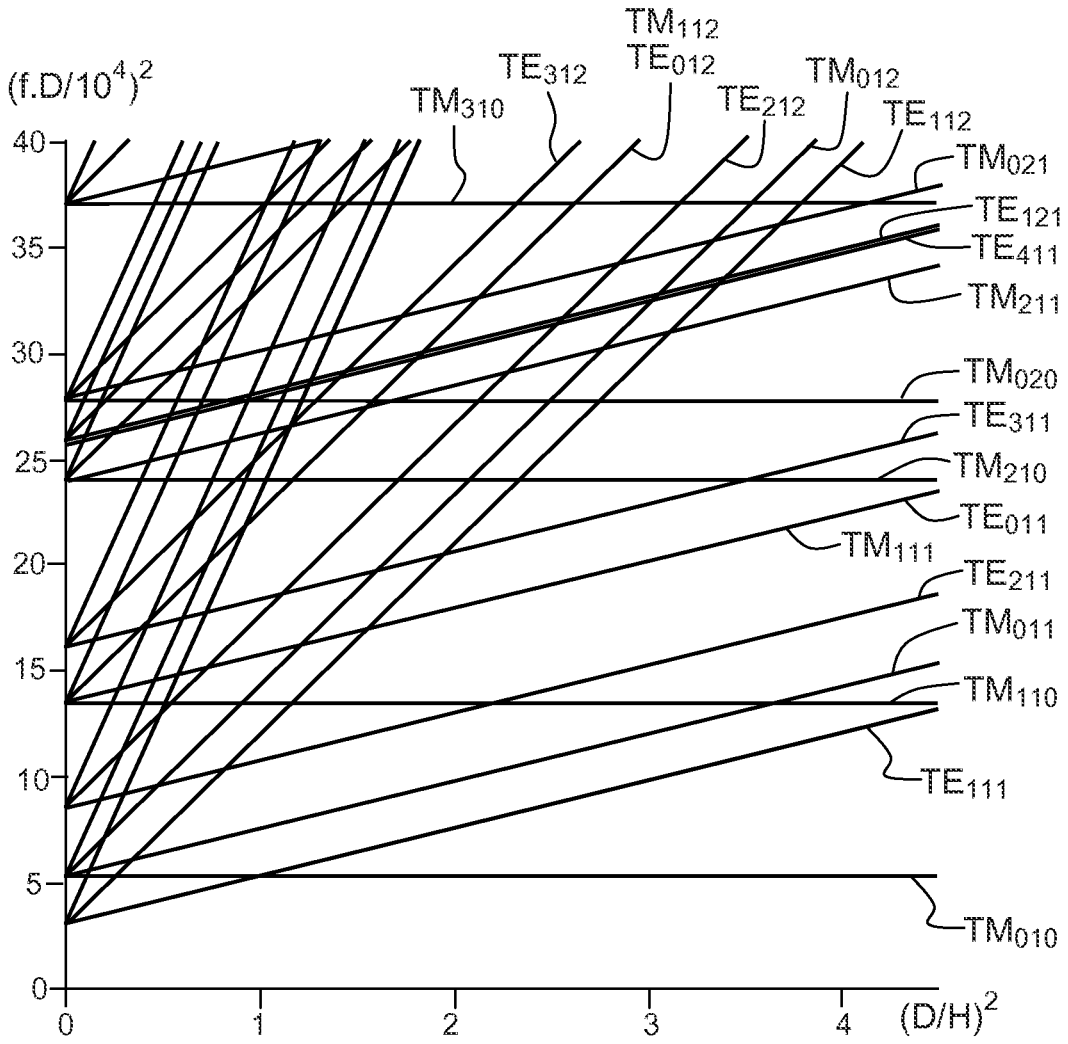
FIG. 1 illustrates the modes of resonance of an empty circular cavity.
Figure 2A:
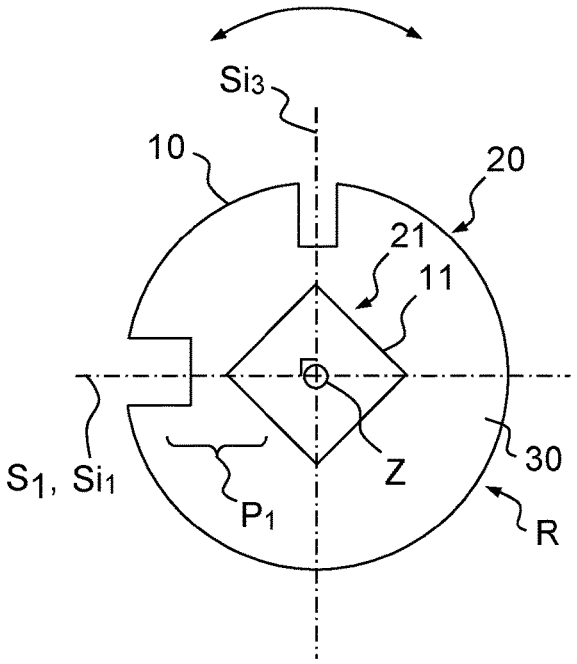
FIGS. 2*a*-2*b* describe a filter according to a variant of the invention according to a cross-section.
Figure 2B:
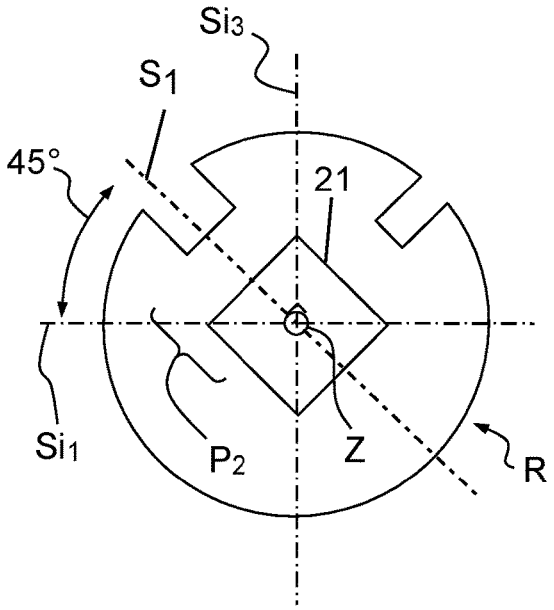

FIGS. 2*a* and 2*b* illustrate a cross-section through a resonator R of the filter, according to the invention, in a plane perpendicular to the axis Z.

The filter operates in a dual mode ("dual mode filter"), thereby signifying that the resonator resonates in at two perpendicular polarizations, referred to as X and Y, which respectively have distributions of the electromagnetic field in the cavity 30 (FIG. 2*a*), the distributions are deduced or obtained from one another by a rotation of 90°.

The two polarizations can resonate at the same frequency or at slightly different frequencies. In the latter case, the frequency response of the filter is dissymmetric.

Moreover, the symmetry of the mode can be slightly broken so as to couple the two polarizations.

In the cavity 30 (FIG. 2*a*), is disposed at least one dielectric element 21 (FIG. 2*a*) is disposed.

The wall of the cavity is overall cylindrical but comprises a specific section, referred to as the insert section 20 (FIG. 2*a*), situated facing the dielectric element 21, that is to say, corresponding to the part of the wall substantially "opposite" the dielectric element 21 in the cavity 30 (FIG. 2*a*). The insert section 20 has a shape 10 (FIG. 2*a*) different from the shape of a section of this same wall not situated facing the dielectric element 21. Preferably, the insert section 20 and the shape of the interior wall of the cavity 30 (FIG. 2*a*), which has a specific shape as shown in FIG. 2*a*.

For example, in FIGS. 2*a* and 2*b*, the wall of the cavity has a cylindrical shape, but the shape of the insert section 10 differs from a circle.

The insert section 20 and the dielectric element 21 are able to perform a rotation with respect to one another in relation to the axis Z so as to define at least a first relative position P1 (FIG. 2*a*) and a second relative position P2 (FIG. 2*b*) differing by an angle substantially equal to 45° to within 20°. FIG. 2*a* shows the resonator R according to the first position P1 and FIG. 2*b* shows the resonator R according to the second relative position P2. The relative angle between the dielectric element 21 and the insert section 20 varies by around 45° (+/−20°) between the two positions. Thus, the relative angle lies between 25° and 65°. Preferably, the relative angle lies between 45° (+/−10°), i.e., lies between 35° and 55°.

The contours of the insert section 20 and the dielectric element 21 are adapted so that the first position P1 (FIG. 2*a*) corresponds to a geometry of resonator resonating according to a first central frequency f1, and the second position P2 (FIG. 2*b*) corresponds to a geometry of a resonator resonating according to a second central frequency f2. Thus, the relative rotation of the dielectric element 21 with respect to the insert section 20 makes it possible to modify the central frequency of the filter according to the invention, according to at least two values f1 and f2 of central frequency, this being adapted for applications of "channel jump" type. Such an effect is obtained by variation of the capacitive effect induced by the rotation, as described further on.

A filter according to the invention thus has numerous advantages. The filter is both dual, with all the associated advantages such as compactness, and tunable. The RF performance of the filter is not substantially degraded by the change of frequency, and neither is the quality factor Q substantially degraded compared with those conventionally obtained with resonant cavities, inter alia, on account of the limited impact of the dielectric element 21 on the losses of the filter. Typically, a Q factor>10000 is obtained for a filter according to the invention, whereas the other known prior art tuning solutions, either are not applicable to the production of a dual-mode filter, or greatly degrade the losses with respect to a filter with no tuning element.

Furthermore, the filter has a narrow band (for example, with respect to performance as a function of frequency). Moreover, the filter is capable of supporting a microwave signal of high power, typically greater than 150 W. These power withstanding capability levels are totally inconceivable with semi-conducting components or MEMS.

According to one embodiment, when one of the two shapes has two orthogonal symmetry planes, the shape having these planes is fixed.

Preferably, the resonator of the filter according to the invention furthermore comprises means of rotation able to produce the rotation.

Preferably, a filter according to the invention has an insert section or an element having properties of particular symmetry allowing the filter to fulfil the desired function in an optimal manner.

Thus, at least one shape from among the shape 10 of the insert section 20 and the shape 11 (FIG. 2*a*) of the dielectric element 21 comprises at least two orthogonal symmetry planes intersecting one another along the axis Z.

In FIGS. 2*a* and 2*b*, by way of example, it is the shape 11 of the dielectric element 21, that is to say the exterior contour of the dielectric element 21 according to a section perpendicular to the axis Z, which comprises at least two orthogonal symmetry planes Si1 and Si3, intersecting one another along the axis Z, shown diagrammatically according to two chained straight lines in the cross-sectional diagrams of FIGS. 2*a* and 2*b*. The angle of rotation can be referenced, for example, with respect to the axes S1 and Si1, but it is the relative angle between the dielectric element 21 and the insert section 20 which varies by around 45° (+/−20°) between the two positions P1 and P2.

Figure 3A:
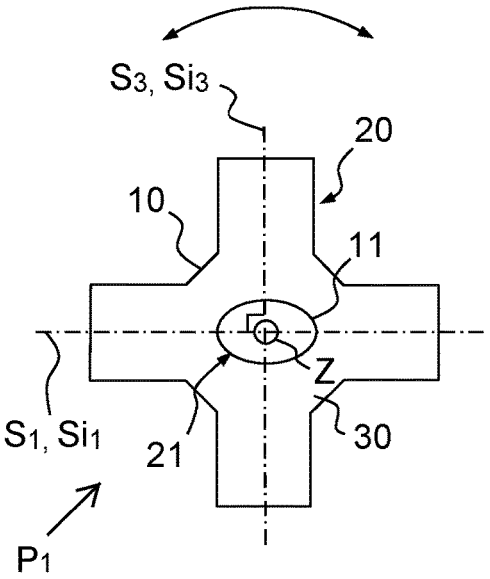
FIGS. 3*a*-3*b* describe a filter according to another variant of the invention according to a cross-section.
Figure 3B:
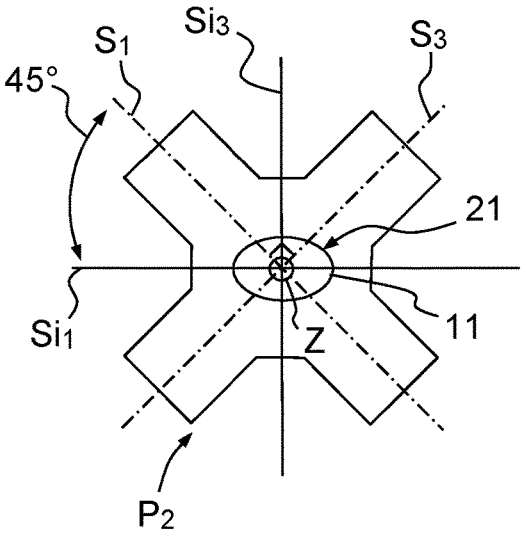

FIGS. 3*a* and 3*b* illustrate another variant of geometry of the shape 10 of the insert section 20 and of the shape 11 of the dielectric element 21 as shown in FIG. 3*a*. FIG. 3*a* shows the resonator R according to the first position P1 and FIG. 3*b* describes the resonator according to the second relative position P2.

In FIG. 3*a*, the shape 10 of the insert section 20, that is to say the perimeter of the wall according to a section facing the dielectric element 21 (preferably the interior perimeter) comprises at least two orthogonal symmetry planes S1 and S3 intersecting one another along the axis Z, shown diagrammatically according to two dotted straight lines in the cross-sectional diagrams of FIGS. 3*a* and 3*b*. The expression "shape of the insert section 10" is intended to mean the overall shape, disregarding the elements for fine adjustment, such as screws at 45° (not represented), locally introducing a slight dissymmetry so as to mutually couple the two polarizations.

In this example, the shape 11 of the dielectric element 21 also has two symmetry planes Si1 and Si3. Thus, according to this variant the shape 10 of the insert section 20 and the shape 11 of the dielectric element 21 each lies in at least two orthogonal symmetry planes, respectively (S1, S3) and (Si1, Si3), intersecting one another along the axis Z.

According to a preferred variant of the resonator R, for easier optimization of the various elements of the filter, the first position P1 is such that the symmetry planes S1 and S3 of the insert section 20 coincide with the symmetry planes Si1 and Si3 of the dielectric element 21 to within a relative angle of 10°, as is illustrated in FIGS. 3*a* and 3*b*.

According to a preferred variant of the resonator R, illustrated in FIGS. 4*a*, 4*b* and 5*a*, 5*b*, the shape 10 of the insert section 20 and/or the shape 11 of the dielectric element 21 has four symmetry planes referred to as S1, S2, S3 and S4 for the insert section 20 and Si1, Si2, Si3 and Si4 for the dielectric element 21, two adjacent symmetry planes being separated by an angle of 45°, and intersecting one another along the axis Z. This geometry also allows a calculation for optimizing the dual-mode filter that is simpler and faster, with a simplified design of the structure of the filter.

Figure 4A:
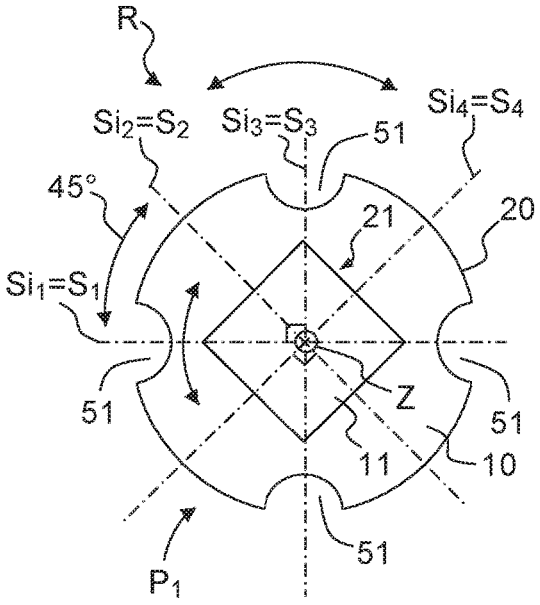
FIGS. 4*a*-4*b* describe a filter according to a preferred variant of the invention comprising at least four orthogonal symmetry planes.
Figure 4B:
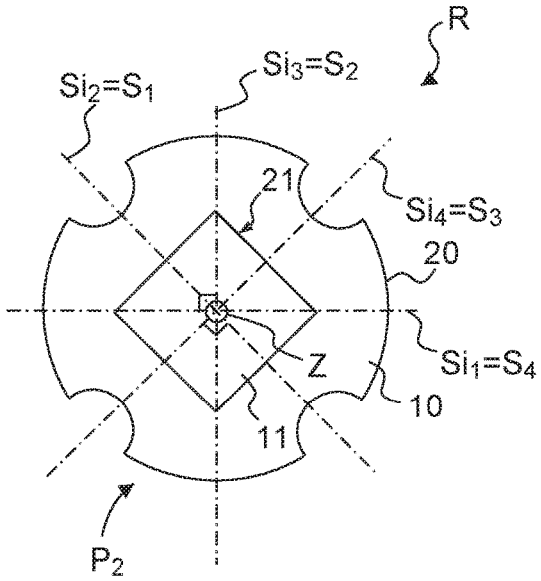

As illustrated in FIGS. 4*a* and 4*b*, for the variant according to which for the position P1 (in FIG. 4*a*) the planes of symmetry coincide, during a rotation of 45° for the position P2 (in FIG. 4*b*), there is always coincidence since the adjacent planes are separated by an angle of 45°.

For example, according to P1:

S1=Si1; S2=Si2; S3=Si3; S4=Si4.

According to P2, for a rotation of 45° of the insert section 20, i.e., planes S1 to S4.

S1=Si2; S2=Si3; S3=Si4; S4=Si1.

Figure 5A:
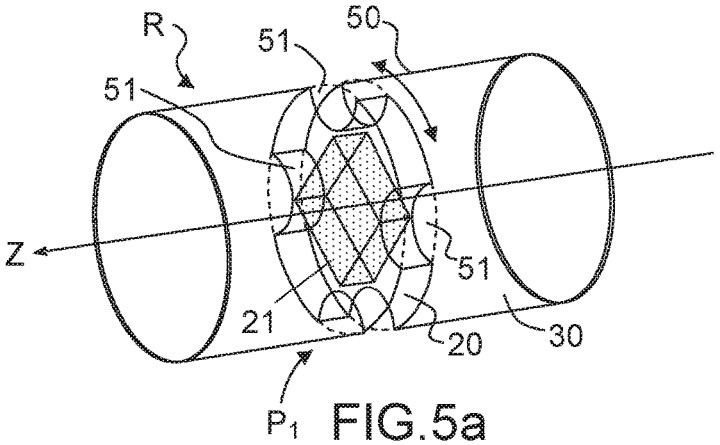
FIGS. 5*a*-5*b* describe the filter of FIGS. 4*a*-4*b* viewed in perspective.
Figure 5B:
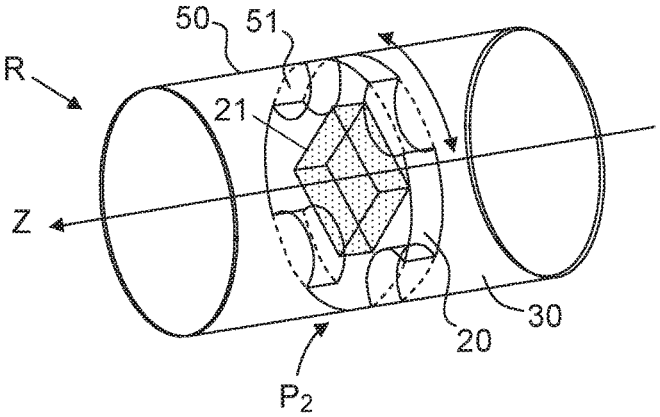
Figure 6A:
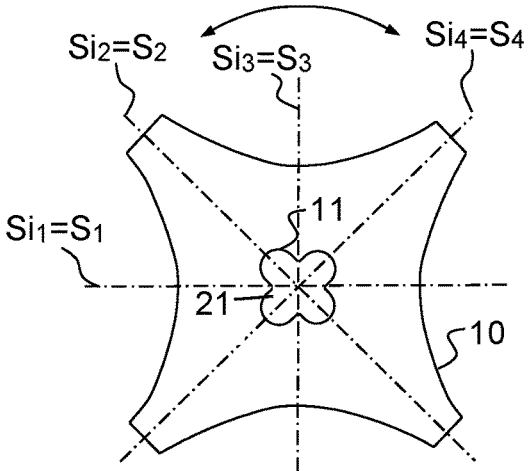
FIGS. 6*a*-6*b* illustrate a variant of shape of insert section and of element according to the invention (FIG. 6*a* for position P1, FIG. 6*b* for position P2)
Figure 6B:
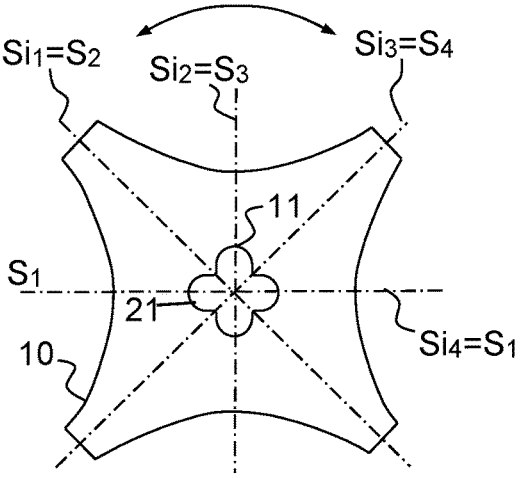
Figure 7A:
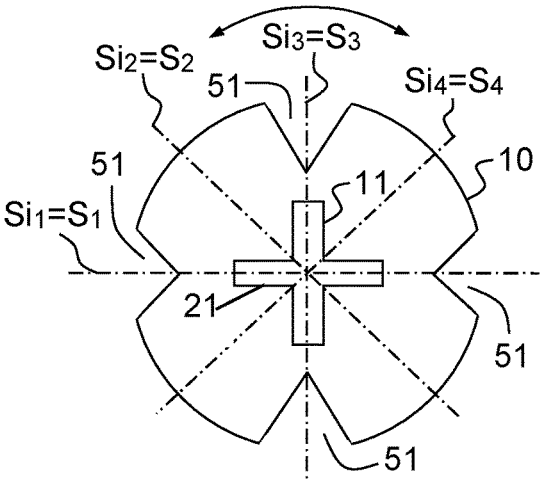
FIGS. 7*a*-7*b* illustrate another variant of shape of insert section and of element according to the invention (FIG. 7*a* for position P1, FIG. 7*b* for position P2)
Figure 7B:
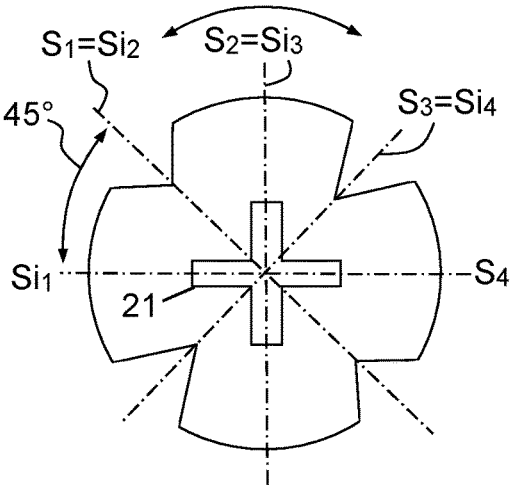

FIGS. 4*a* and 4*b* are each a sectional view perpendicular to the axis Z, and FIGS. 5*a* and 5*b* are each a perspective view, making it possible to depict the insert section 20. FIGS. 4*a* and 5*a* describe the resonator R according to the first position P1 and FIGS. 4*b* and 5*b* describe the resonator R according to the second relative position P2.

FIGS. 4*a*, 4*b* and 5*a*, 5*b* also illustrate a first variant in which it is the insert section 20 which is movable with respect to the dielectric element 21. Preferably, the insert section 20 is also movable with respect to the conducting wall 50 of the resonator R, so as to preserve the continuity of the wall 50. An insert section 20 that is movable in rotation is then disposed inside the cavity 30. The shape of the insert section 20 is obtained by adding metallic parts 51 (shown in FIGS. 4*a*, 5*a*, which are, for example, convex shaped when considering these surfaces from the interior of the cavity 30), along the section, these parts 51 locally modifying (locally decreasing in the example shown) in the regions facing the dielectric element 21, the diameter of the cavity 30 and therefore, the distance between the dielectric element 21 and the metallic wall 50. For example, the insert section 20 corresponds to an adjusting ring or disk that is rendered movable, as indicated by the curved bi-directional arrows in FIGS. 4*a* and 5*b*. According to the azimuthal angle, the radius of the ring or disk is variable, so the perturbation seen by the two (2) polarizations X and Y is different in the positions P1 and P2.

For example, the adjusting ring or disk is rendered movable with the aid of a revolving seal rotating so as to maintain electrical continuity between the fixed part and the movable part.

In FIGS. 5*a* and 5*b* in perspective, the structures of the dielectric element 21 and of the insert section 20 in the direction Z are homogeneous with respect to each other. This homogeneity corresponds to a preferred embodiment that is simpler to implement, but the Z-wise structure could also be variable.

A cylindrical surface is defined by a director curve (i.e., a base) described by a straight line referred to as the generator of the cylinder. The director curve or base of the wall of the filter according to the invention is preferably a circle or a square, for reasons of intrinsic symmetry of this type of cavity, and of ease of design and manufacture.

A dual mode is preferably established according to certain particular modes of cavity, corresponding therefore to the preferred embodiments of the invention. An example is the mode of type TE11n (or H11n), n corresponding to the number of variations of the electric field (minima or maxima) along the axis Z of the cavity. According to a preferred embodiment, n=3, this case corresponding to a compromise between bulkiness and electrical performance (losses and frequency isolation).

Figure 8A:
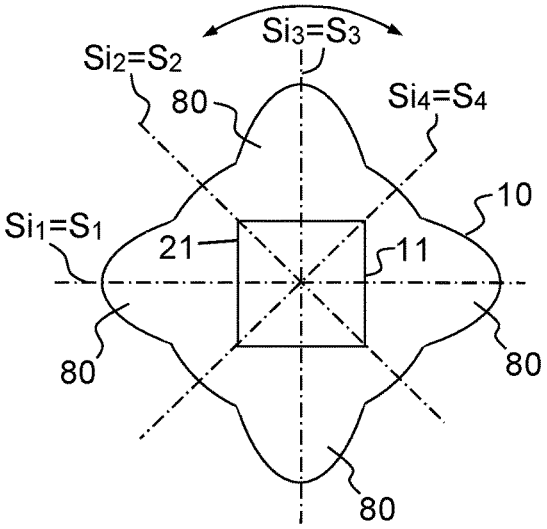
FIGS. 8*a*-8*b* illustrate another variant of shape of insert section and of element according to the invention (FIG. 8*a* for position P1, FIG. 8*b* for position P2)
Figure 8B:
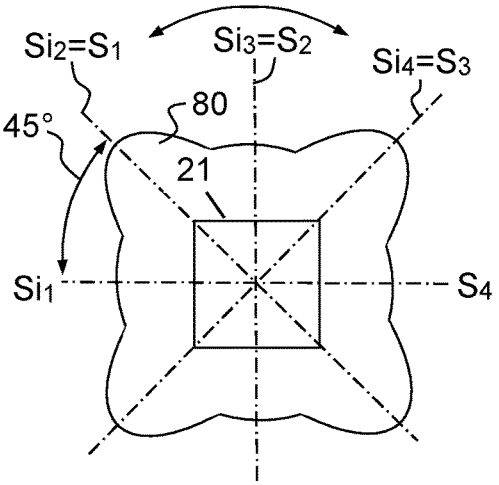

FIGS. 6*a*, 6*b*, 7*a*, 7*b*, 8*a*, and 8*b* illustrate variants of shapes of insert section 10 and of the dielectric element 21 and of relative rotation of one with respect to the other of a resonator according to the invention. In FIGS. 8*a* and 8*b* concavities 80 (viewed from the interior of the cavity) locally increase the distance between the dielectric element 21 and the metallic wall.

To comply with the symmetry conditions while obtaining a variation of the capacitive effect, according to one embodiment, the shape of the insert section and/or the shape of the dielectric element 21 has concavities and/or convexities whose extrema are situated in the vicinity of axes of symmetry of the resonator.

For the insert section 20 such shapes are in the vicinity of the symmetry planes (S1, S2, S3, S4). For the dielectric element 21 such shapes are in the vicinity of the symmetry planes (Si1, Si2, Si3, Si4).

This embodiment is compatible with a system comprising only two symmetry planes, as illustrated in FIGS. 2*a*, 2*b*, 3*a*, and 3*b*.

Furthermore, it is of course not necessary for concavity/convexity to exist in the vicinity of each axis of symmetry, the constraint being to comply with the symmetry condition.

Figure 9A:
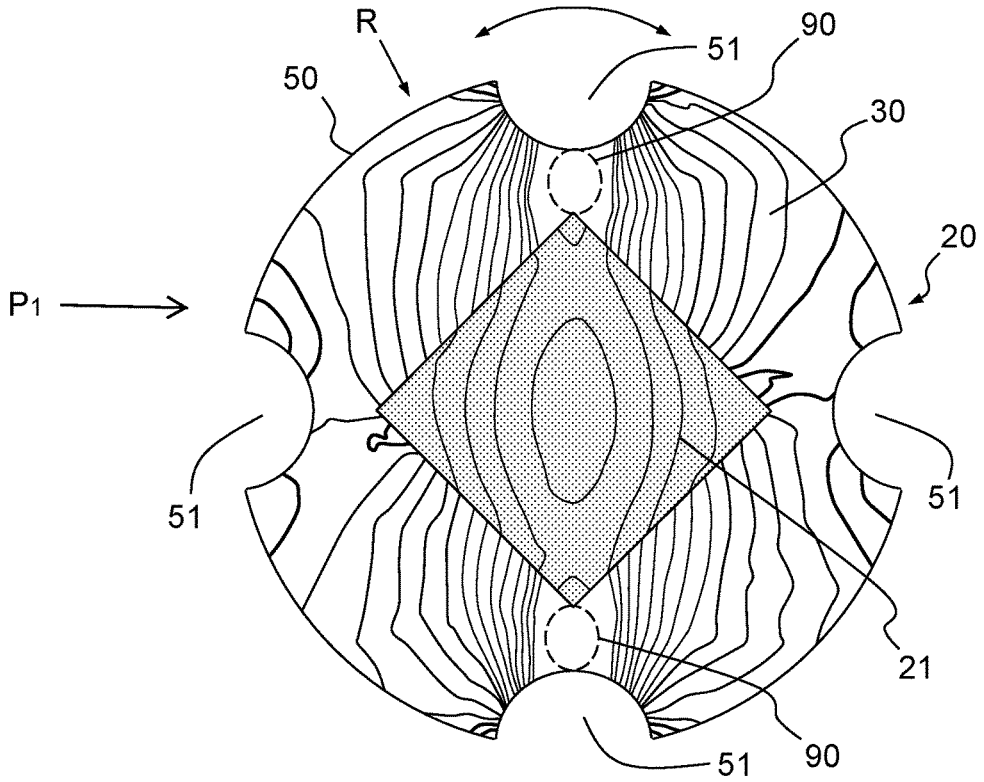
FIGS. 9*a*-9*b* illustrate the variations of the electric field of a polarization resonating in the cavity of the resonator of the filter according to the invention.
Figure 9B:
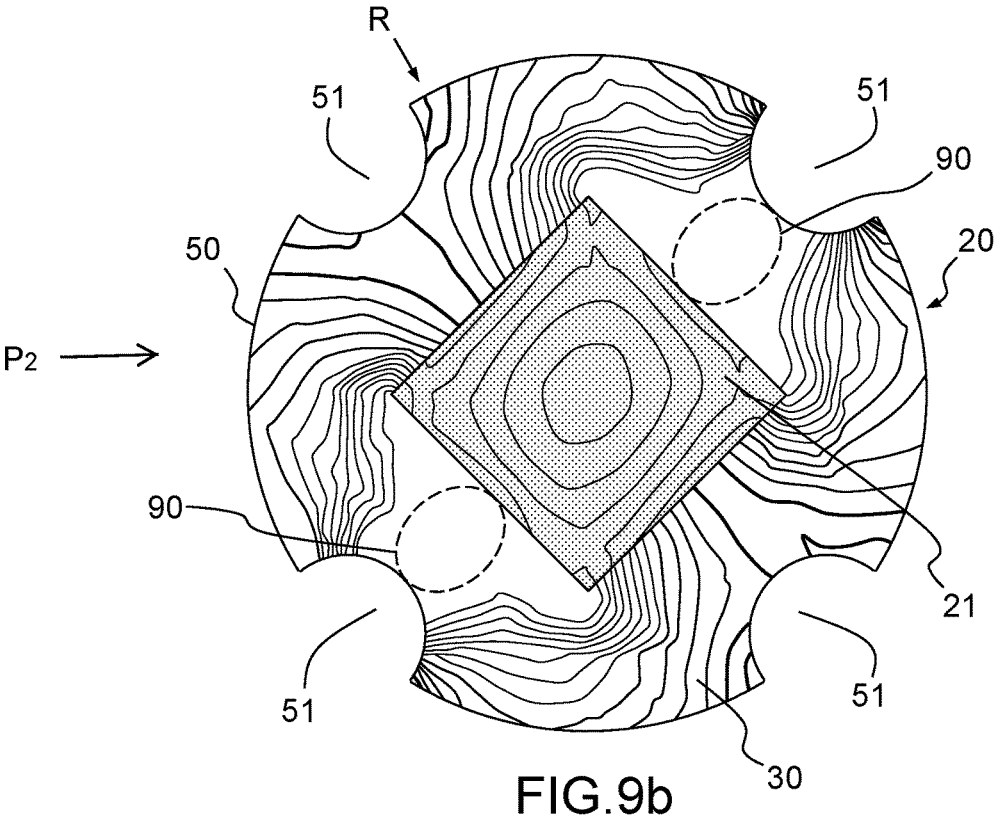

FIGS. 9*a* and 9*b* illustrate the variations of the electric field of one of the polarizations (X or Y) resonating in the cavity of the resonator R of FIGS. 4*a*, 4*b*, 5*a*, and 5*b*. FIG. 9*a* shows the resonator R according to the first relative position P1 and FIG. 9*b* shows the resonator R according to the second relative position P2, for which the insert section 20 has performed a rotation of 45° with respect to the dielectric element 21. The dashed zones referenced 90 illustrate the zones for which the electric field has a maximum.

For the first position P1, the electric field is concentrated between the tips of the dielectric element 21 and the convexities/protuberances 51 of the insert section 20.

For the second position P2 this electric field is concentrated between the edges of the dielectric element 21 and the convexities 51.

Modification of the resonant frequency of the filter is obtained by variation of the capacitive effect between the dielectric element 21 and the insert section 20. Indeed, it is possible to model the frequency behaviour of a resonator by an equivalent electrical circuit: a resistance-capacitance-inductance in parallel association (RLC resonator). This circuit possesses a resonant frequency dependent on the product L.C. When the capacitive effect is altered, the value of the capacitance varies, giving rise to a variation of the resonant frequency.

The capacitive effect induced by the presence of a dielectric element is dependent on its geometry and on the characteristics of the material of which it is composed (dielectric permittivity), and also on the mode of resonance (in particular on the associated distribution of the electromagnetic field). As a function of the mode (or of the polarization for a dual mode), the electromagnetic field is influenced by only a part of the dielectric element 21. A variation of the shape of the dielectric element 21 in zones of large amplitude of the electric field modifies the capacitive effect of the resonator R. The contrast obtained in the capacitive effect is maximized when this variation is located on an electric field maximum. In the case of a dual-mode filter, the effect must be globally the same on each polarization to obtain the same frequency shift for both polarizations.

As a variant, the filter comprises a plurality of resonators and coupling means adapted for coupling together two adjacent resonators.

Figure 10A:
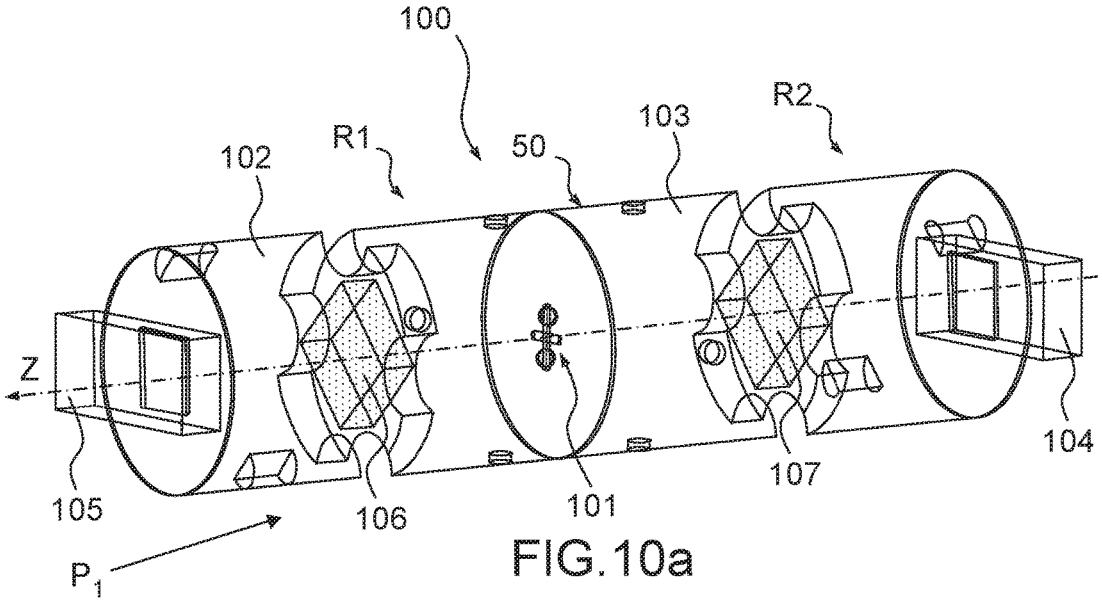
FIGS. 10*a*-10*b* illustrate a filter comprising two resonators each comprising a cavity and a dielectric element, the resonators being coupled together with the aid of a coupling means (FIG. 10*a* for position P1, FIG. 10*b* for position P2).
Figure 10B:
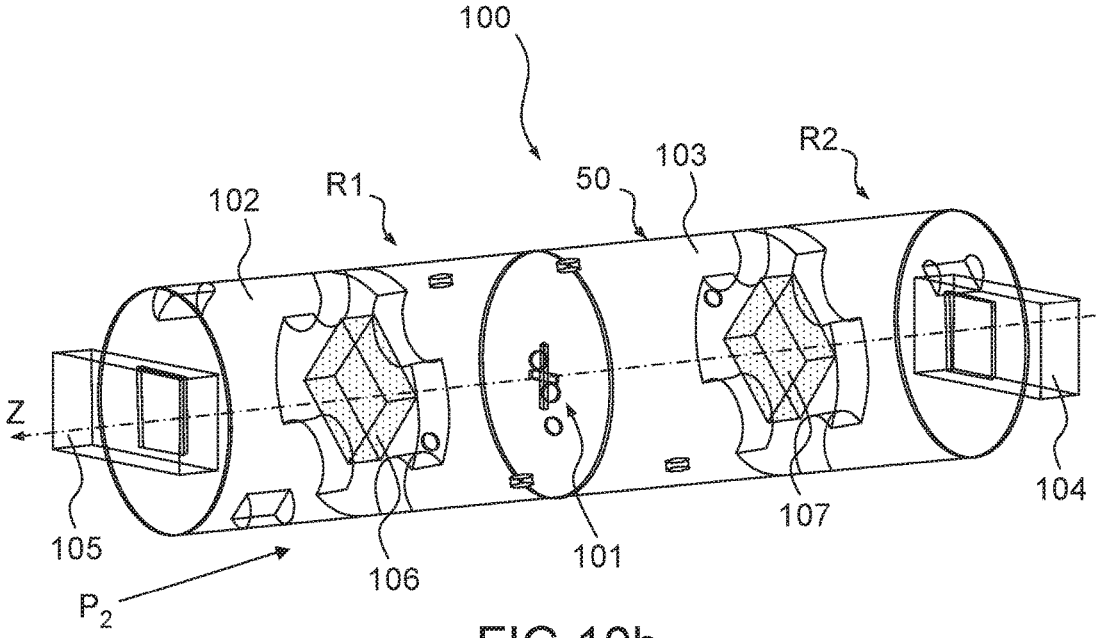

FIGS. 10*a* and 10*b* (FIG. 10*a* for position P1, FIG. 10*b* for position P2) illustrate a filter 100 (FIG. 10*a*) comprising two resonators R1 and R2 each comprising a respective cavity 102 and 103, and a respective dielectric element 106, 107, the resonators R1 and R2 being coupled together with the aid of a coupling means 101 shown as an iris in FIGS. 10*a* and 10*b*. Input means 104 and output means 105 allow the microwave-frequency wave, to respectively, enter and to exit the filter.

Figure 11:
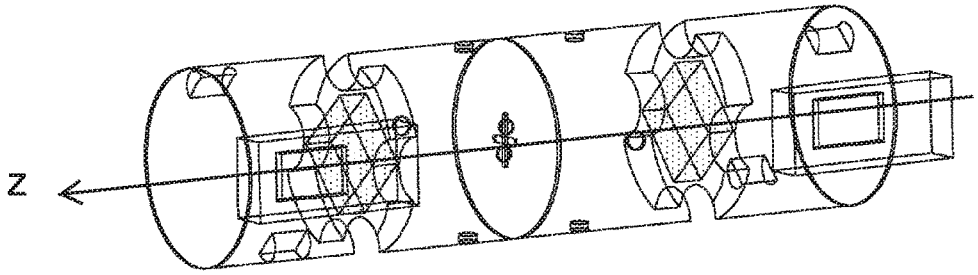
FIG. 11 illustrates a filter according to the invention having input and output means producing a lateral coupling.

The cylindrical metallic wall 50 is in this example common to the two cavities, and the coupling is carried out through the bottom. But the filter according to the invention is of course compatible with a lateral coupling, as illustrated in FIG. 11.

The filter 100 of FIGS. 10*a* and 10*b* comprises two cavities, each resonating at two polarizations, and thus constitutes a so-called "4-pole" filter.

Figure 12:
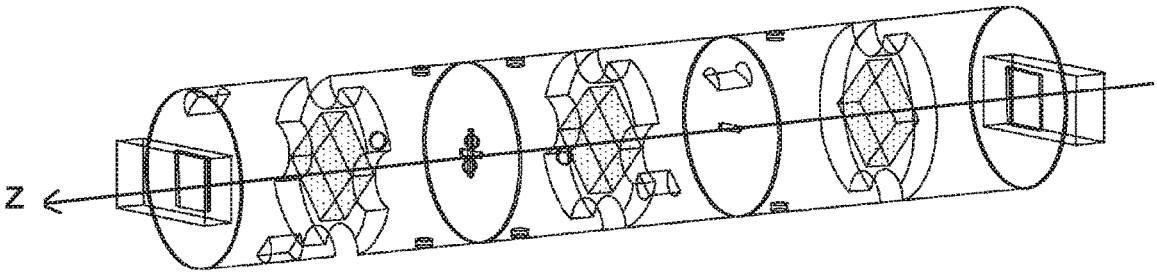
FIG. 12 illustrates a filter comprising three resonators.

The invention is of course compatible with 3 (or more) cavities, making it possible to obtain a narrower passband filter, such as that illustrated in FIG. 12.

Figure 13A:
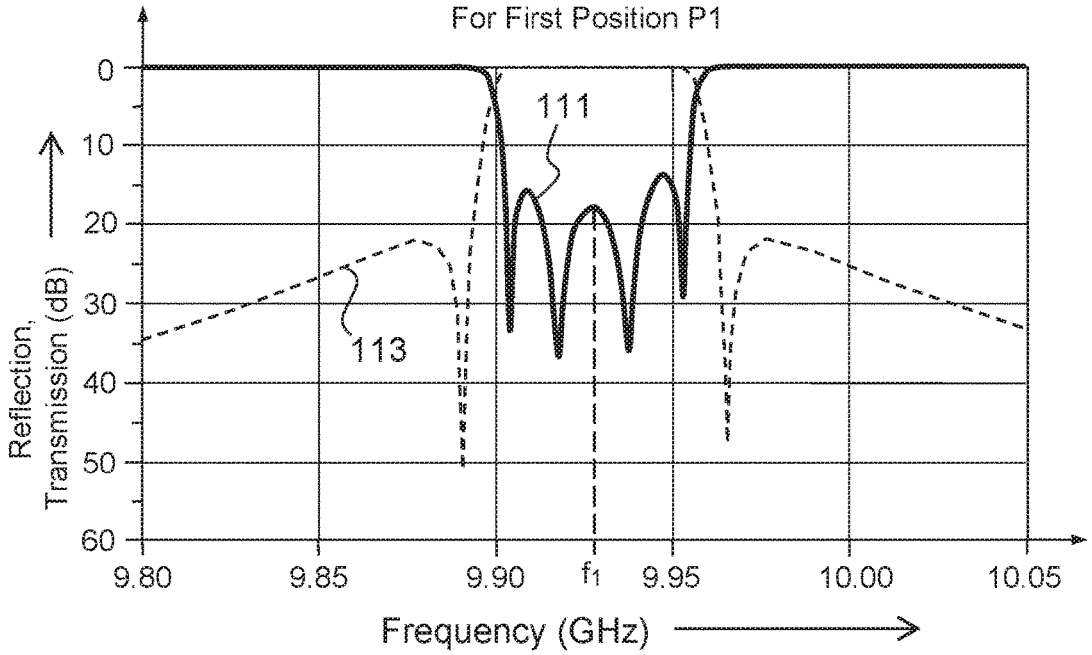
FIGS. 13*a*-13*b* illustrate the frequency behaviour of the filter of FIGS. 10*a* and 10*b*.
Figure 13B:
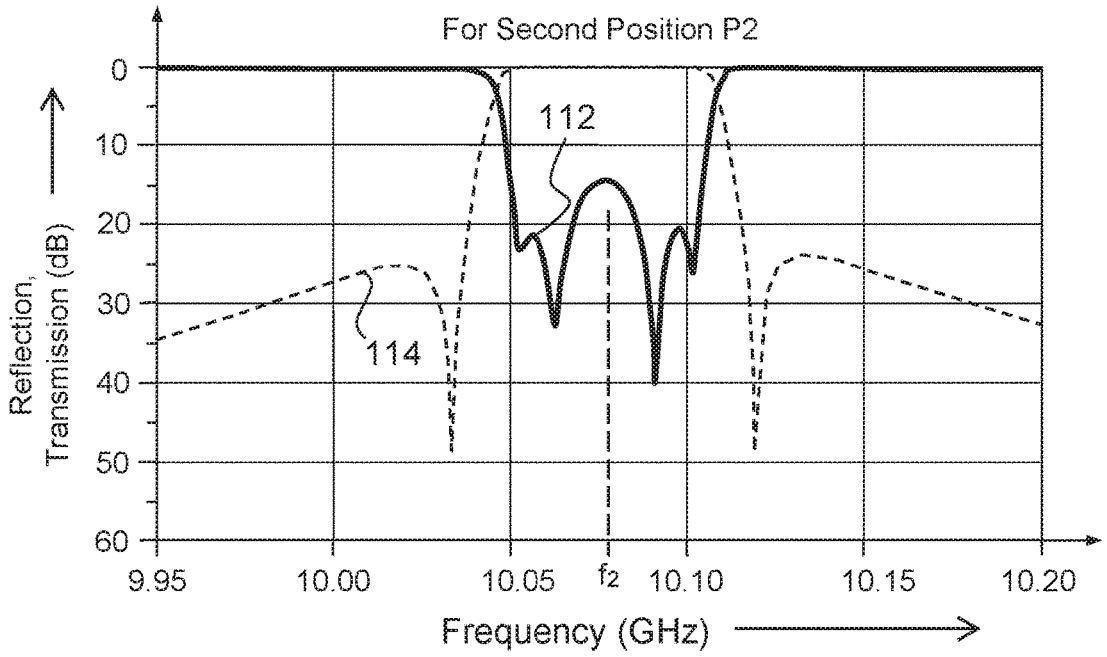

An example of frequency behaviour of the filter of FIGS. 10*a* and 10*b* is illustrated in FIGS. 13*a* and 13*b* (FIG. 13*a* for position P1, FIG. 13*b* for position P2). FIG. 13*a* illustrates, on the vertical axis, reflection and transmittance (in dB) as a function of the frequency (in GHz), on the horizontal axis, for the first position P1. FIG. 13*b* illustrates, on the vertical axis, reflection and transmittance (in dB) as a function of the frequency (in GHz), on the horizontal axis, for the second position P2. The dual mode of the filter is of type H113 and the parameters of the filter of this example are:

Total length: 90 mm; diameter of the cylinder 27 mm; use of a movable adjusting ring; the dielectric element 21 (shown in FIGS. 10*a*, 10*b*, for example) made of alumina (permittivity 9.4) of square shape with side 12 mm×12 mm and of Z-wise thickness 4 mm. The curves 111 and 112 (solid line) corresponds to the curves of type S11 (reflection of the filter) and the curves 113 and 114 (dashed line) to the curves of type S21 (transmission of the filter). Between the two positions P1 (corresponding to FIG. 13*a*) and P2 (corresponding to FIG. 13*b*), a variation of about 150 MHz, (1.5%) of the resonant frequency is noted.

Figure 14A:
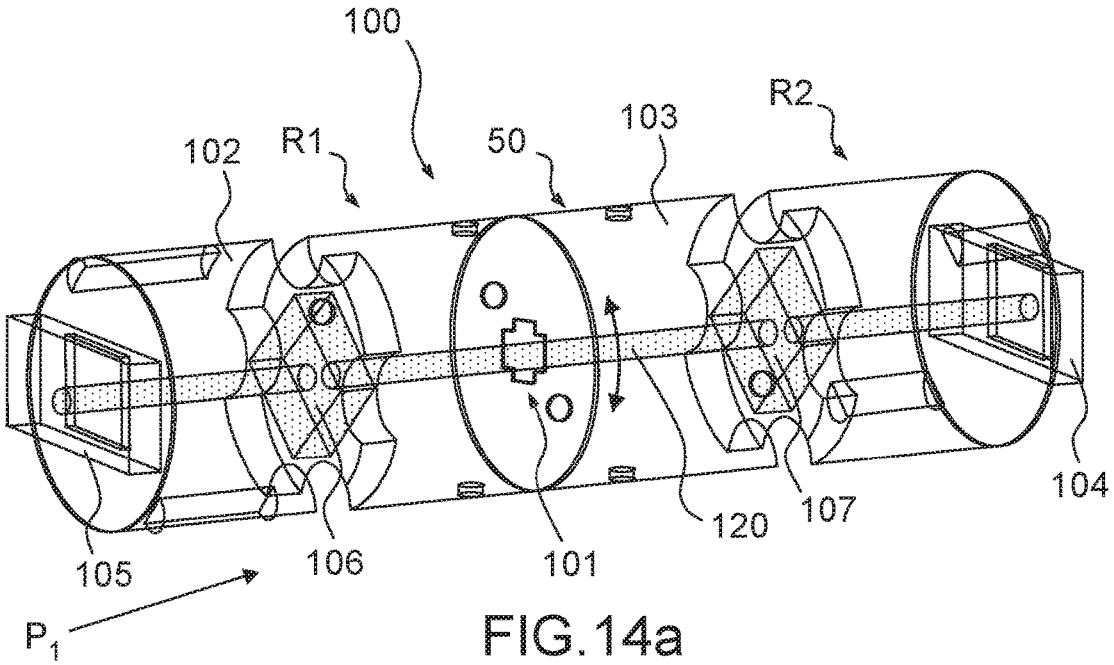
FIGS. 14*a*-14*b* describe a second variant of the invention according to which the dielectric element is movable with respect to the conducting wall.
Figure 14B:
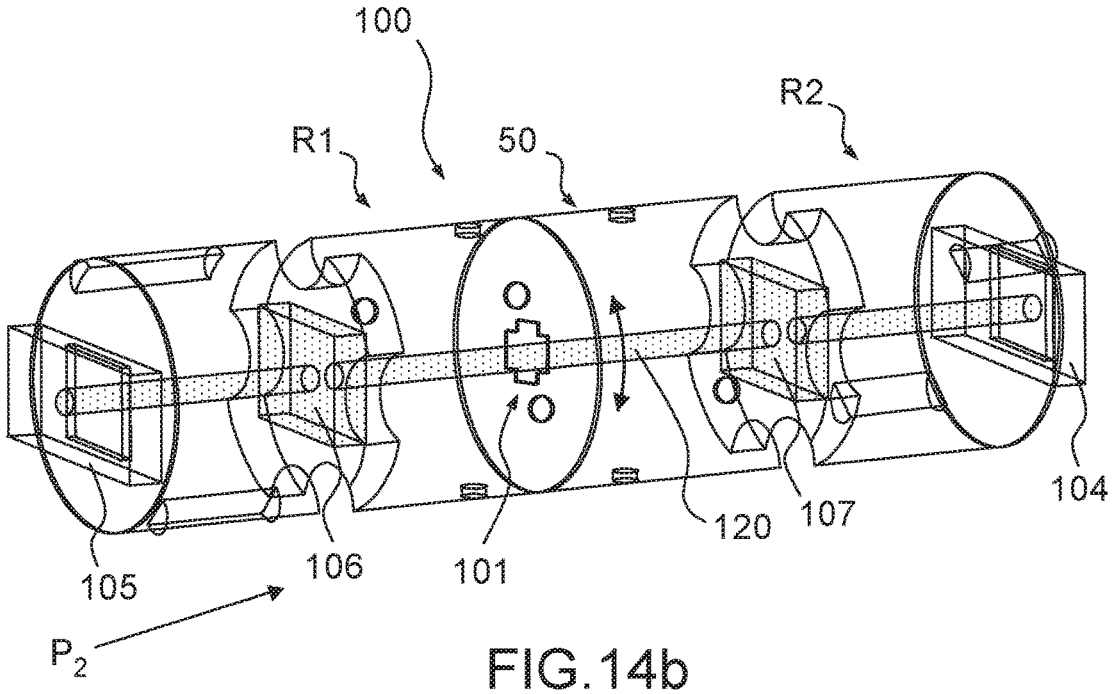

According to a second variant of the invention illustrated in FIGS. 14*a* and 14*b* (FIG. 14*a* for position P1, FIG. 14*b* for position P2, the reference numerals being same as those in FIGS. 10*a* and 10*b* and hence not being described with respect to FIGS. 14*a* and 14*b*), the dielectric element 21 (in FIGS. 4*a*, 4*b*, 5*a*, and 5*b*) or the plurality of dielectric elements 106, 107 is/are movable (as indicated by curved bi-directional arrows) with respect to the conducting wall and with respect to the insert section 20 which is fixed. In this example, the means of rotation comprise a rod 120 of dielectric material rigidly attached to the dielectric element 21 (in FIGS. 4*a*, 4*b*, 5*a*, and 5*b*), or to a plurality of dielectric elements 106, 107 when the structure of the cavities so allows, such as in FIG. 12. Indeed, in FIG. 12, the coupling is carried out through the bottom of the base (relative to the Z axis), or laterally from the side (if a lateral horizontal axis is considered for FIG. 12), the successive dielectric elements are thus aligned along one and the same axis and can therefore all be rigidly attached to one and the same rod. This geometry has the advantage of allowing the control of the whole set of rotations of the plurality of dielectric elements with one and the same element. This geometry is, of course, compatible with a lateral coupling, rather than through the bottom as illustrated in FIGS. 14*a* and 14*b*.

In one embodiment, the filter furthermore comprises linking means adapted for equalizing the respective rotations of the means of rotation of the resonators.

For the second variant in which the dielectric elements are movable and rigidly attached to one and the same rod 120, the rod 120 is also a linking means. The means of rotation can also comprise a stepper motor to control the rotation of the dielectric elements, in the case where a reconfiguration of the filter must be performed in flight, for example.

According to another aspect, the subject of the invention is also a microwave circuit comprising at least one filter according to the invention.

The invention claimed is:

1. A bandpass dual mode filter for a microwave-frequency wave, the bandpass dual mode filter being frequency tunable, the bandpass dual mode filter comprising:

at least one resonator, each of said at least one resonator including:

a respective cavity having a conducting wall shaped substantially cylindrical in relation to an axis Z, and a respective dielectric element disposed inside the corresponding cavity, said at least one resonator resonating at two perpendicular polarizations having respectively distributions of an electromagnetic field in the respective cavity, said distributions of the two perpendicular polarizations being obtained from one another by a rotation of the respective dielectric element by of 90° around an axis of symmetry of the at least one resonator, the conducting wall of the respective cavity including an insert section facing said respective dielectric element, said insert section having a different shape from a shape of a section not facing the respective dielectric element, the insert section and the respective dielectric element being configured to perform a rotation with respect to one another in relation to the axis Z to define at least a first relative position and a second relative position differing by an angle substantially equal to 45° to within 20°.

2. The bandpass dual mode filter according to claim 1, wherein the respective dielectric element is movable with respect to the corresponding conducting wall.

3. The bandpass dual mode filter according to claim 1, wherein the shape of the insert section and a shape of the respective dielectric element each include at least two orthogonal symmetry planes intersecting one another along the axis Z.

4. The bandpass dual mode filter according to claim 3, wherein the first relative position is such that said at least two orthogonal symmetry planes of the insert section coincide with said at least two orthogonal symmetry planes of the respective dielectric element to within 10°.

5. The bandpass dual mode filter according to claim 1, wherein at least one shape from among the shape of the insert section and a shape of the respective dielectric element has four symmetry planes, two consecutive symmetry planes being separated by an angle of 45°, and intersecting one another along the axis Z.

6. The bandpass dual mode filter according to claim 1, in which a mode of resonance of the bandpass dual mode filter, an $H_{113}$ resonance mode having three maxima of the electromagnetic field in said respective cavity along the axis Z.

7. The bandpass dual mode filter according to claim 1, in which the respective substantially cylindrical shaped conducting wall has a base chosen from among a circle and a square.

8. The bandpass dual mode filter according to claim 1, wherein at least one shape from among the shape of the insert section and a shape of the respective dielectric element includes at least two orthogonal symmetry planes intersecting one another along the axis Z.

9. The bandpass dual mode filter according to claim 8, wherein at least one shape from among the shape of the insert section and the shape of the respective dielectric element has concavities and/or convexities having extrema which are situated in a vicinity of the orthogonal symmetry planes.

10. The bandpass dual mode filter according to claim 1, wherein the insert section is movable with respect to the corresponding conducting wall.

11. The bandpass dual mode filter according to claim 10, wherein the movable insert section comprises a respective movable adjustable disk.

12. The bandpass dual mode filter according to claim 1, wherein the at least one resonator further comprises means of rotation configured to carry out said rotation.

13. The bandpass dual mode filter according to claim 12, wherein said means of rotation comprise a rod rigidly attached to the respective dielectric element and comprising a dielectric material.

14. The bandpass dual mode filter according to claim 1, further comprising:

a plurality of resonators that include the at least one resonator and coupling means adapted for coupling together two adjacent resonators in the plurality of resonators.

15. The bandpass dual mode filter according to claim 14, further comprising linking means adapted for making all respective angles of rotation associated with the means of rotation equal.

16. The bandpass dual mode filter according to claim 15, wherein the linking means comprise a rod rigidly attached to a plurality of dielectric elements disposed along the rod, said plurality of dielectric elements including at least one dielectric element.

17. A microwave circuit comprising at least one of the bandpass dual mode filter according to claim 1.

* * * * *